US006694633B1

(12) United States Patent
Nyquist

(10) Patent No.: US 6,694,633 B1
(45) Date of Patent: Feb. 24, 2004

(54) COMMON RAFTER AND HIP LAYOUT TOOL

(76) Inventor: Shelby M. Nyquist, 610 Country Rd. 112, Burnet, TX (US) 78611

( * ) Notice: Subject to any disclaimer, the term of this patent is extended or adjusted under 35 U.S.C. 154(b) by 0 days.

(21) Appl. No.: 10/222,690

(22) Filed: Aug. 16, 2002

(51) Int. Cl.[7] ..... B43L 7/10

(52) U.S. Cl. ..... 33/452; 33/417; 33/423; 33/425; 33/471; 33/23.01

(58) Field of Search ..... 33/418, 419, 423, 33/424, 415, 416, 417, 425, 427, 452, 464, 465, 471, 472, 23.01, 25.1, 25.2, 25.3, 41.1

(56) References Cited

U.S. PATENT DOCUMENTS

| | | | | | |
|---|---|---|---|---|---|
| 15,600 | A | | 8/1856 | Crofoot | |
| 697,335 | A | * | 4/1902 | Hagan | 33/341 |
| 813,173 | A | * | 2/1906 | Realing | 33/341 |
| 820,311 | A | * | 5/1906 | Oehrle | 33/341 |
| 1,491,048 | A | * | 4/1924 | Kuehl et al. | 33/472 |
| 1,532,353 | A | * | 4/1925 | Waldron | 33/341 |
| 1,983,516 | A | * | 12/1934 | Ahola | 33/419 |
| 2,212,331 | A | | 8/1940 | Tracy | |
| 2,504,244 | A | * | 4/1950 | Barclay | 33/419 |
| 2,667,190 | A | * | 1/1954 | Delano | 33/427 |
| 2,759,267 | A | * | 8/1956 | Wood et al. | 33/419 |
| 2,908,080 | A | * | 10/1959 | Varbel | 33/423 |
| 3,065,546 | A | * | 11/1962 | Brocklander | 33/425 |
| 3,080,657 | A | * | 3/1963 | Lanski | 33/452 |
| 3,427,722 | A | * | 2/1969 | Ingram | 33/452 |
| 4,352,247 | A | * | 10/1982 | Rohde | 33/428 |
| 4,607,438 | A | | 8/1986 | DeFrange | |
| 4,712,307 | A | | 12/1987 | Kish | |
| 4,761,890 | A | | 8/1988 | Morrell | |
| 5,205,045 | A | * | 4/1993 | Liu | 33/468 |
| 5,384,967 | A | | 1/1995 | Helmuth | |
| 5,388,339 | A | * | 2/1995 | Roach et al. | 33/419 |
| 5,419,053 | A | | 5/1995 | Kathan | |
| 5,440,818 | A | * | 8/1995 | Mailhot | 33/452 |
| 5,461,794 | A | * | 10/1995 | Huang | 33/470 |
| 5,617,642 | A | * | 4/1997 | Marios | 33/526 |
| 6,293,028 | B1 | | 9/2001 | Sylvia | |

* cited by examiner

*Primary Examiner*—Diego Gutierrez
*Assistant Examiner*—Yaritza Guadalupe

(57) ABSTRACT

A common rafter and hip layout tool which provides a protractor portion, a common cut marking edge, a common cut marking edge pantograph arm to which is connected a bird's mouth marking arm, a seat cut marking arm connected at a right angle to the bird's mouth marking arm and a tail length marking arm. The pantograph arm and connected bird's mouth marking arm facilitates the marking of the bird's mouth cut and the seat cut. Movement of the common cut marking edge to the location indicated by the tail length marking arm facilitates the making of parallel cuts for the common rafter ridge cut and the tail cut.

4 Claims, 4 Drawing Sheets

COMMON RAFTER AND HIP LAYOUT TOOL

BACKGROUND OF THE INVENTION a. Field of the Invention

The present invention is related generally to the field of devices and tools useful in marking roof rafters for cutting to shape for installation.

More particularly the present invention is related to devices and tools useful in marking roof rafters for cutting to shape for installation that provide for the marking of the common cuts to be made in a roof rafter, the common ridge cut, the bird's mouth or seat cut, and the tail end cut.

Yet more particularly, the present invention is related to devices and tools that provide for marking of the physical relationship between the tail cut and the seat cut and, therefore, do not require a separate measurement be taken before marking of the seat cut.

Yet more particularly, the present invention is related to devices and tools that provide for ease of use in that multiple manual adjustments do not have to be made by the user in order to maintain the angular relationship of the rafter ridge cut and the seat cut.

In a yet further and final point of particularity, the present invention is related to devices and tools that are specifically designed for use in laying out the common cuts to be marked and made for a common roof rafter so that their manner of use is specifically and clearly indicated.

b. Description of the Prior Art

The common roof rafter is cut at its uppermost end at an angle so that the roof rafter, when installed, will provide the proper pitch to the roof while making a flush joinder to the roof ridge. This uppermost end cut is called the common ridge cut. At the lowermost end the common roof rafter is cut at an angle parallel to that of the common ridge cut so that the lowermost or tail end of the common roof rafter will be perpendicular to the ground, which is presumed to be level, and parallel to the vertical walls of the structure being roofed. At some point between the common ridge cut and the tail end cut the common roof rafter will cross over or lie upon the frame of the vertical wall of the structure being roofed. It is desirable that a cut be made in the common roof rafter such that the common roof rafter will provide a parallel surface to set upon the top of the vertical wall's frame. This cut is often called a bird's mouth cut or seat cut and permits the maximum load bearing surface from the common roof rafter to sit upon the top of the vertical wall's frame. Thus the three cuts that need to be made in a length of material to form a common roof rafter are the common ridge cut, the seat cut, and the tail cut.

Several devices and tools have been developed to assist the craftsman in the task of repetitively marking with appropriate angles and lengths for cutting lengths of material to be used as roof rafters. Such devices and tools include those disclosed by the following described U.S. Patents.

U.S. Pat. No. 15,600 discloses an instrument for laying out rafters which may be used for marking the common ridge cut and the tail cut, but doesn't make provision for the marking of the seat cut.

U.S. Pat. No. 2,212,331 discloses a carpenter's roof lay-out gauge which requires for its use the manual parallel alignment of a cross bar and the straight edge of a plate (page 2, lines 21–25) in order to mark the seat cut.

U.S. Pat. No. 4,712,307 discloses a rafter angle measuring device which incorporates a level into one arm, but does not make provision for measuring or marking of the seat cut.

U.S. Pat. No. 4,761,890 discloses an adjustable carpenters measuring tool which combines the functions of a square, a level, and a bevel tool into a single device. The single device does not provide for marking of the physical relationship between the tail cut and the seat cut, and thus requires a separate measurement be taken.

U.S. Pat. No. 5,384,967 discloses a collapsible rafter square which is adapted for the marking of plumb and level lines on roof rafters. The collapsible rafter square does not provide for marking of the physical relationship between the tail cut and the seat cut, and thus requires a separate measurement be taken.

U.S. Pat. No. 5,419,053 discloses a measuring tool which, by overlay of two protractor elements, permits calculation and marking of common rafter cut angles. The measuring device does not provide for marking of the physical relationship between the tail cut and the seat cut, and thus requires a separate measurement be taken.

U.S. Pat. No. 5,440,818 discloses a measuring device which, by cooperation of two protractor elements, permits the layout and marking of roof rafters. The measuring device does not provide for marking of the physical relationship between the tail cut and the seat cut, and thus requires a separate measurement be taken.

U.S. Pat. No. 6,293,028 discloses a construction tool which is useful for the marking of locations for the roof ridge cut, seat cut, and tail cut; however, no provision is made for setting the angle of such cuts.

Accordingly, it can be seen that the prior art provides less than ideal solutions for the problem commonly encountered by carpenters and craftsmen in laying out and marking common roof rafters for the roof ridge cut, seat cut, and tail cuts.

A first problem encountered in the prior art is that some prior art devices do not provide for the marking of the seat cut.

A further problem encountered in the prior art is that some prior art devices do not provide for marking of the physical relationship between the tail cut and the seat cut and, therefore, require a separate measurement be taken.

A yet further problem encountered in the prior art is that some prior art devices do not provide for ease of use in that multiple manual adjustments have to be made by the user in order to maintain the angular relationship of the rafter ridge cut and the seat cut.

A yet further and final problem encountered in the prior art is that some prior art devices by their design for general applicability to uses in the construction trades do not specifically and clearly indicate their use in laying out the common cuts to be marked and made for a common roof rafter.

SUMMARY OF THE INVENTION

The instant invention is of a common rafter and hip layout tool, useful in marking the common cuts to be made in a roof rafter. The common cuts to be made in a roof rafter are, at the uppermost end of the roof rafter, the common ridge cut; at the lowermost end of the roof rafter, the tail end cut, and at the point between the common ridge cut and the tail end cut where the common roof rafter will cross over or lie upon the frame of the vertical wall of the structure being roofed, the bird's mouth cut or seat cut.

Accordingly, it is an object of this invention to provide a device which is useful in marking roof rafters for cutting to shape for installation.

It is a further object of this invention to provide a device which is useful in marking roof rafters for cutting to shape for installation that provides for the marking of the common cuts to be made in a roof rafter, the common ridge cut, the bird's mouth or seat cut, and the tail end cut.

It is a yet further object of this invention to provide a device which provides for marking of the physical relationship between the tail cut and the seat cut and, therefore, do not require a separate measurement be taken before marking of the seat cut.

It is a yet further object of this invention to provide a device which provides for ease of use in that multiple manual adjustments do not have to be made by the user in order to maintain the angular relationship of the rafter ridge cut and the seat cut.

It is a yet further and final object of this invention to provide a device which is specifically designed for use in laying out the common cuts to be marked and made for a common roof rafter so that its manner of use is specifically and clearly indicated.

Description of Numeric References

1. Common Rafter and Hip Layout Tool of the instant invention
10. Main Body of the Common Rafter and Hip Layout Tool
11. Slot in Main Body of the Common Rafter and Hip Layout Tool
12. Head Region of the Main Body of the Common Rafter and Hip Layout Tool
13. Slot in Head Region of the Main Body of the Common Rafter and Hip Layout Tool
14. Protractor Portion of the Head Region of the Main Body of the Common Rafter and Hip Layout Tool
15. First Aperture in Main Body of the Common Rafter and Hip Layout Tool
16. Second Aperture in Main Body of the Common Rafter and Hip Layout Tool
17. First Spacer on Main Body of the Main Body of the Common Rafter and Hip Layout Tool
18. Second Spacer on Main Body of the Main Body of the Common Rafter and Hip Layout Tool
20. Common Cut Marking Edge and Roof Pitch Pointer Arm
21. Indicator Point on Common Cut Marking Edge and Roof Pitch Pointer Arm
22. First Aperture in Common Cut Marking Edge and Roof Pitch Pointer Arm
23. Second Aperture in Common Cut Marking Edge and Roof Pitch Pointer Arm
24. Third Aperture in Common Cut Marking Edge and Roof Pitch Pointer Arm
30. Bird's Mouth Marking Arm
31. Slot in Bird's Mouth Marking Arm
32. First Aperture in Bird's Mouth Marking Arm
33. Second Aperture in Bird's Mouth Marking Arm
34. Row of Apertures
40. Tail Length Marking Arm
41. Indicator Point on Tail Length Marking Arm
42. Aperture in Tail Length Marking Arm
50. Synchronizing Bar
51. First Aperture in Synchronizing Bar
52. Second Aperture in Synchronizing Bar
60. Tail Length Adjustment Knob
61. Dog Point Thumb Knob
62. Protractor Locking Knob
70. Tail Length Adjustment Knob Nut
71. First Seat Cut Marking Arm Press Pin
72. Second Seat Cut Marking Arm Press Pin
73. Bird's Mouth Marking Arm Press Pin
74. First Synchronizing Bar Press Pin
75. Common Cut Marking Edge and Roof Pitch Pointer Arm Press Pin
76. Second Synchronizing Bar Press Pin
77. Protractor Locking Knob Nut
80. Seat Cut Marking Arm
81. First Aperture in Seat Cut Marking Arm
82. Threaded Aperture in Seat Cut Marking Arm
83. Third Aperture in Seat Cut Marking Arm
90. Vertical Member of Frame
91. Foundation Member of Frame
92. Top of Frame
100. Common Roof Rafter
101. Common Ridge Cut on Common Roof Rafter
102. Seat Cut on Common Roof Rafter
103. Tail Length of Common Roof Rafter
104. Tail Cut on Common Roof Rafter

BRIEF DESCRIPTION OF THE DRAWINGS

While the novel features of the instant invention are set forth with particularity in the appended claims, a full and complete understanding of the invention can be had by referring to the detailed description of the preferred embodiment(s) which are set forth subsequently, and which are as illustrated in the accompanying drawings, in which:

DESCRIPTION OF THE PREFERRED EMBODIMENT(S)

Figure 1:
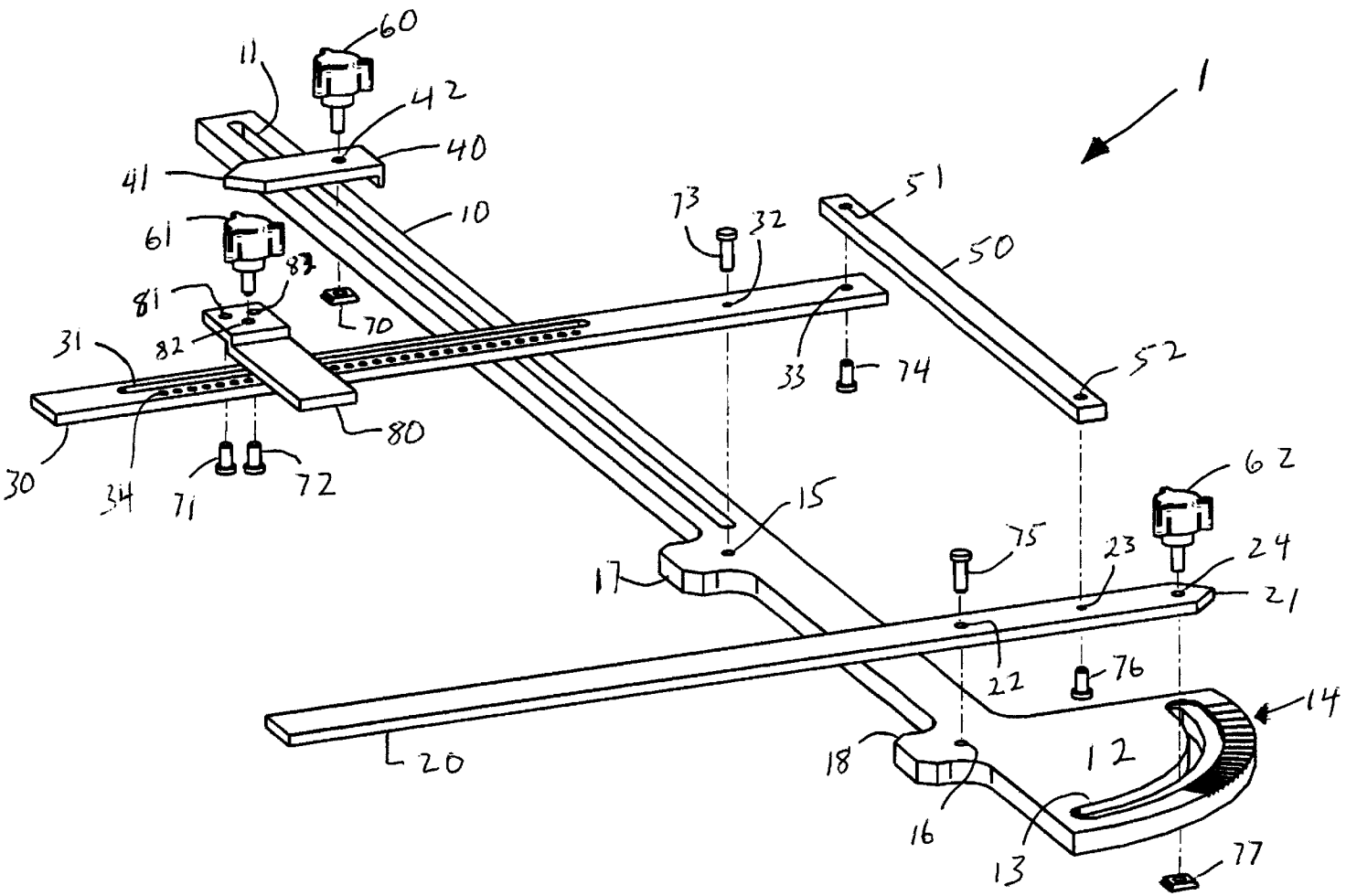
FIG. 1 is an exploded perspective view of the instant invention, separately depicting its constituent components.
Figure 2:
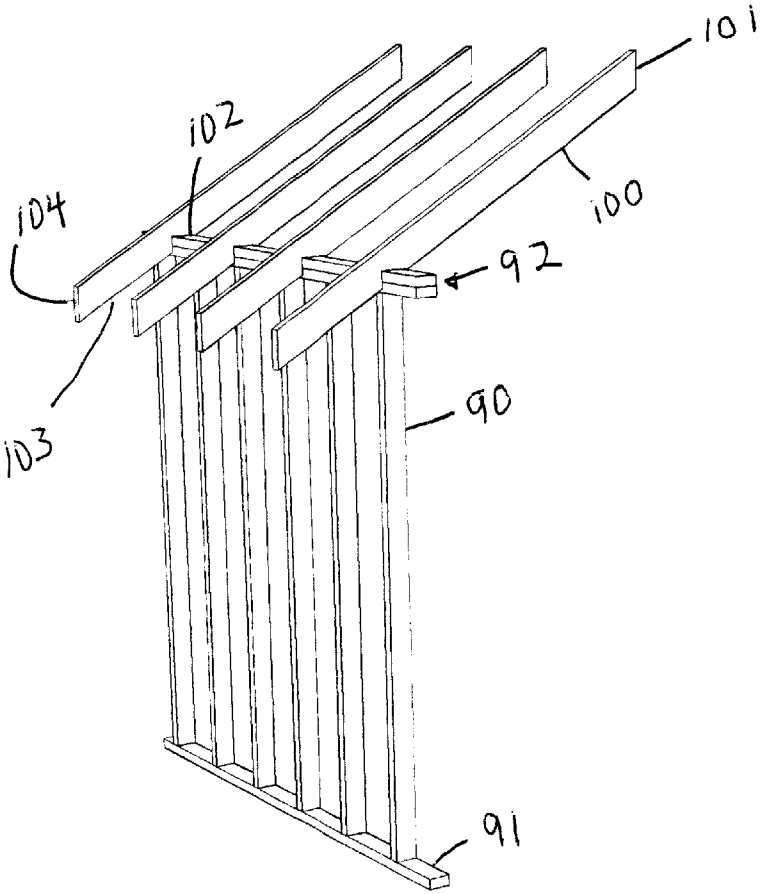
FIG. 2 is a perspective view of a section of vertical wall frame with common roof rafters positioned thereon.

As seen by reference to FIGS. 1 and 2, the instant invention is of a common rafter and hip layout tool 1, useful in marking the common cuts to be made in a roof rafter 100. The common cuts to be made in a roof rafter 100 are, at the uppermost end of the roof rafter 100, the common ridge cut 101; at the lowermost end of the roof rafter 100, the tail end cut 104, and at the point between the common ridge cut 101 and the tail end cut 104 where the common roof rafter 100 will cross over or lie upon the top member of the frame 92 of the vertical wall of the structure being roofed, the bird's mouth cut or seat cut 102.

The common rafter and hip layout tool 1 of the instant invention is, in major division, comprised of a main body 10, a common cut marking edge 20, a bird's mouth marking arm 30, a tail length marking arm 40, a synchronizing bar 50, and a seat cut marking arm 80.

The main body 10 is an elongated bar with a slot 11 cut approximately mid-width and running longitudinally the length of the main body 10. The main body 10 additionally provides a head region 12 at one end of the main body's 10 length. The main body 10 further provides a first aperture 15 and a second aperture 16 for insertion of press pins as discussed hereinafter. The head region 12 of the main body 10 provides a radially disposed set of angular demarcations comprising the protractor portion 14 of the head region 12.

The radial disposition of the angular demarcations is relative to a circle centered at the second aperture 16. Further, the head region 12 additionally provides a second slot 13 which lies on the circumference of a circle centered at the second aperture 16. Finally, the main body 10 provides a first lateral spacer region 17 and a second lateral spacer region 18. The top surfaces of the lateral spacer regions 17 and 18 of the main body 10 are in the same plane as the top surface of the main body 10 and constitute protuberances laterally from the main body 10 whereby the main body 10 is held some slight distance away from the edge of the roof rafter 100 when the roof rafter 100 is being marked for common cuts.

The common cut marking edge 20 is an elongated bar with a pointer 21 at one end and provides first, second, and third apertures, 22, 23, and 24 respectively, for insertion of press pins 75 and 76 as will be hereinafter discussed and a knob 62.

The bird's mouth marking arm 30 is an elongated bar with a slot 31 cut approximately mid-width and running longitudinally partway along the length of the bird's mouth marking arm 30. The bird's mouth marking arm 30 provides a first aperture 32 and a second aperture 33 for insertion of press pins as discussed hereinafter, and additionally provides a row of apertures 34 which is parallel to the slot 31 for connection of the seat cut marking arm 80.

The tail length marking arm 40 provides a pointer 41 at one end and a lip or flange at the other end to slideably engage the outer edge of the main body 10. The tail length marking arm 40 further provides an aperture 42 to receive a press pin as hereinafter described.

The synchronizing bar 50 provides a first aperture 51 and a second aperture 52 to receive press pins as hereinafter described.

The seat cut marking arm 80 provides a first aperture 81 to receive a press pin as hereinafter described, a threaded aperture 82 to screwably receive the threaded portion of the dog point thumb knob 61, and a third aperture 83 to receive a press pin as hereinafter described. The seat cut marking arm 80 is shaped such that its bottom surface provides an indented region for receipt of press pin heads so that press pins inserted into the first and third apertures 82, and 83 respectively, do not scrape the surface of the roof rafter 100 when it is being marked.

The common rafter and hip layout tool 1 is constructed from the major components above-identified, as follows:

First, the common cut marking edge and roof pitch pointer arm 20 is placed on top of the main body 10 with the first aperture 22 aligned with the second aperture 16 of the main body 10, the second aperture 23 aligned with the slot 13 in the main body 10, and the third aperture 24 aligned with slot 13 in the main body 10; then the press pin 75 is inserted through the first aperture 22, the press pin 76 is inserted upwardly through the slot 13 and into the second aperture 23, and the protractor locking knob 62 is inserted through the third aperture 24 and the slot 13 and screwably fastened into the protractor locking knob nut 77.

Second, the bird's mouth marking arm 30 is placed on top of the main body 10 with the first aperture 32 aligned with the first aperture 15 in the main body 10, then the press pin 73 is inserted through the first aperture 32 and into the first aperture 15. Following attachment of the bird's mouth marking arm 30 to the main body 10 as described, the synchronizing bar 50 is placed on top of the bird's mouth marking arm 30 with the first aperture 50 of the synchronizing bar 50 aligned with the second aperture 33 of the bird's mouth marking arm 30. Press pin 74 is inserted from below through second aperture 33 and into first aperture 51 to pivotally connect the synchronizing bar 50 to the bird's mouth marking arm 30.

The synchronizing bar 50 is pivotally connected to the common cut marking edge and roof pitch pointer arm 20 by inserting press pin 76 from below through the slot 13 in the main body 10, then through the second aperture 23 in the common cut marking edge and roof pitch pointer arm 20, then upwardly into the second aperture 52 of the synchronizing bar 50. Connection of the synchronizing bar 50 pivotally to both the common cut marking edge and roof pitch pointer arm 20 and the bird's mouth marking arm 30 as indicated in FIG. 1 results in the formation of a pantograph whereby the common cut marking edge and roof pitch pointer arm 20 is maintained in parallel with the bird's mouth marking arm 30 so that the angular setting of the pointer 21 on the common cut marking edge and roof pitch pointer arm 20 relative to the protractor portion 14 of the head region 12 of the main body 10 causes like angle to be assumed by the bird's mouth marking arm 30. Tightening of the protractor locking knob 62 assures that the common cut marking edge and roof pitch pointer arm 20 stays in the angular position relative to the protractor portion 14 that the user selects.

Third, the tail length marking arm 40 is slideably attached to the main body 10 by insertion of the tail length adjustment knob 60 through the aperture 42 and through the slot 11 in the main body 10, and then secured by screwably tightening the tail length adjustment knob 60 into the tail length adjustment knob nut 70. By loosening the tail length adjustment knob 60, the tail length marking arm 40 is permitted to slide along the length of the main body 10 within the slot 11.

Fourth, the set cut marking arm 80 is slideably attached to the bird's mouth marking arm 30 by screwably inserting the dog point thumb knob 61 into the threaded aperture 82 in the bird's mouth marking arm 30 and fitting the point of the dog point thumb knob 61 into one of the apertures 34 in the seat cut marking arm 80. The apertures 34 are arranged in a row, parallel to the slot 31, on the top surface of the bird's mouth marking arm 30, as seen in FIG. 1. The stability of the seat cut marking arm 80 and right angle relationship between the seat cut marking arm 80 and the bird's mouth marking arm 30 are assured by insertion of the pressing pin 71 through the slot 31 into the aperture 81 and the insertion of the pressing pin 72 through the slot 31 into the aperture 83. Pressing pins 71 and 72 may then slide lengthwise in slot 31 while being held in place firmly by apertures 81 and 83 in the seat cut marking arm 80.

An alternate embodiment of the instant invention provides that the stability of the bird's mouth marking arm 30 is assured by the downward insertion of the pressing pin 71 through the first aperture 81 into a shallow groove (not depicted in the drawings) which takes the place of the apertures 34 on the top surface bird's mouth marking arm 30 and the insertion of the pressing pin 72 downward through the third aperture 83 into the above-mentioned shallow groove (not depicted in the drawings) on the top surface of the bird's mouth marking arm 30. The shallow groove not depicted in the drawings is parallel to the slot 31, takes the place of the row of apertures 34 and acts as a track for the ends of pressing pins 71 and 72 to slideably engage the bird's mouth marking arm 30 while maintaining an angle of 90° between the long axis of the seat cut marking arm 80 and the long axis of the bird's mouth marking arm 30.

Figure 4:
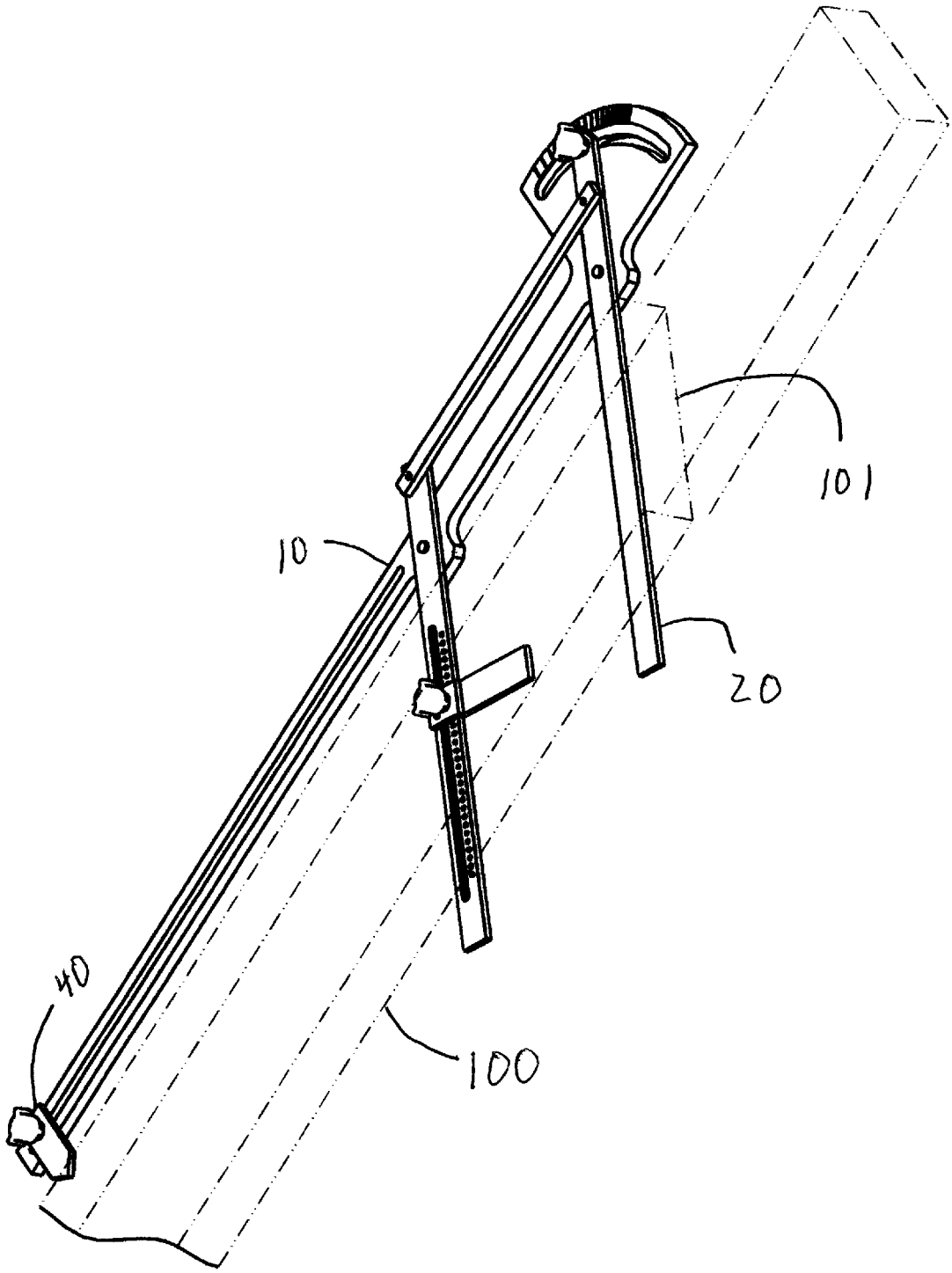
FIG. 4 is a perspective view of the instant invention in position on a length of material for marking of the common ridge cut.

In operation, see FIG. 4, the preferred embodiment of the instant invention, the common rafter and hip layout tool 1 is placed lengthwise adjacent a roof rafter 100 to be marked. The spacing of the common rafter and hip layout tool 1 from the roof rafter 100 is controlled by the size of the protuberances 17 and 18 on the side of the main body 10. The desired angle of the common ridge cut 101 on the common roof rafter 100 is set by adjustment of the common cut marking edge and roof pitch pointer arm 20 until the pointer 21 points to an angular reading on the protractor 14 equal to the correct roof pitch. The relative positions of the main body 10 and the common cut marking edge and roof pitch pointer arm 20 are locked in place by screwably tightening the protractor locking knob 62 into the protractor locking knob nut 77. The common ridge cut 101 to be made on the common roof rafter 100 is marked by tracing the upper edge of the common cut marking edge and roof pitch pointer arm 20 on the surface of the common roof rafter 100.

Figure 3:
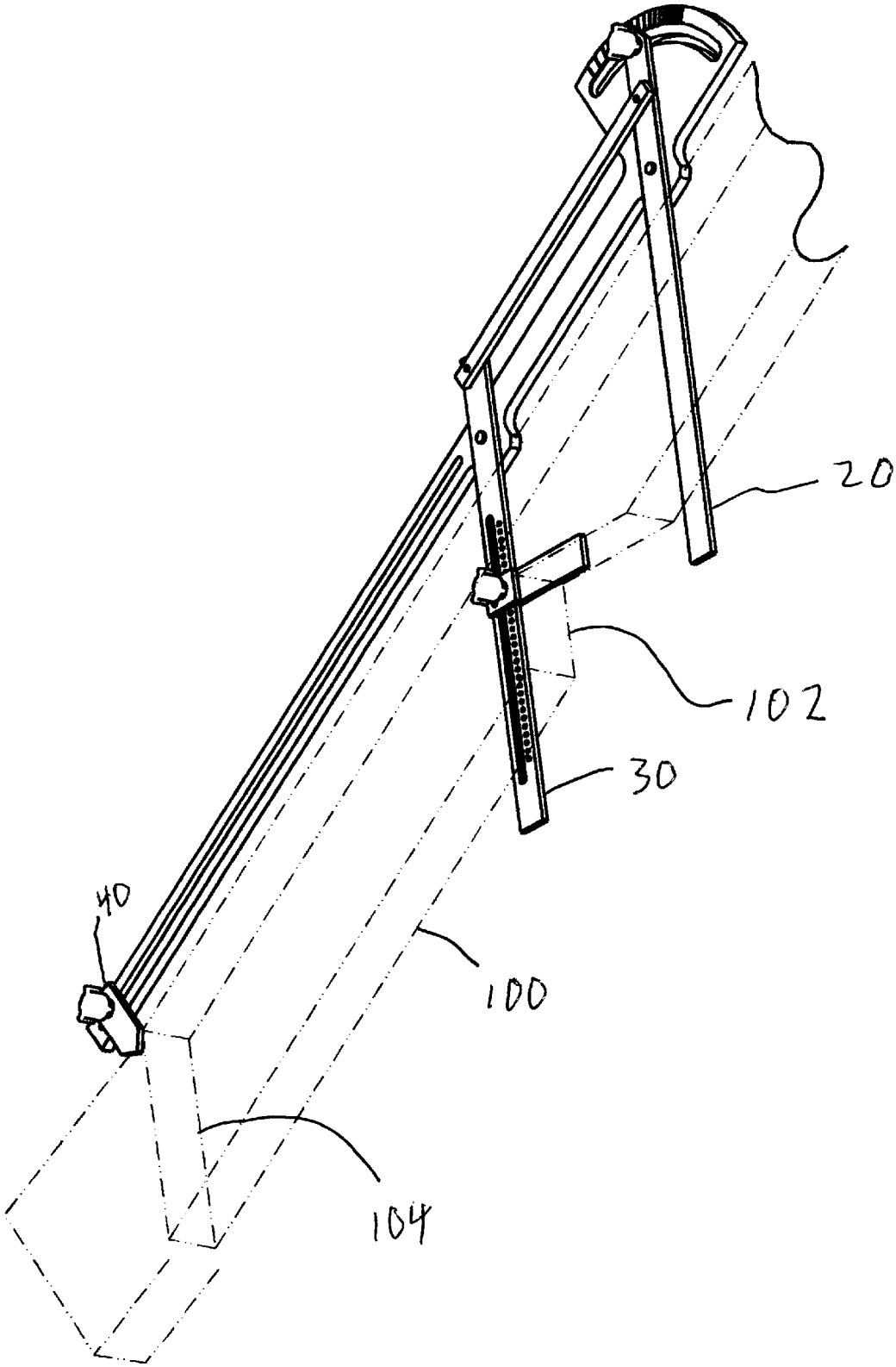
FIG. 3 is a perspective view of the instant invention in position on a length of material for marking of the seat cut and the tail cut.

Next, the desired tail length 103, see FIG. 2, is measured along the main body 10 between the tail length marking arm 40 and the lower edge of the bird's mouth cut 102, see FIG. 3. The tail length marking arm 40 is slideably moved along the main body 10 until it is a distance equal to the desired tail length 103 away from the lower edge of the bird's mouth marking arm 30, then the tail length marking arm 40 is locked in position by tightening tail length adjustment knob 60 into the tail length adjustment knob nut 70. The desired tail length 103 is marked on the common roof rafter 100 where indicated by the pointer 41 of the tail length marking arm 40.

Then, the depth of the desired seat cut is set by slideably adjusting the position of the seat cut marking arm 80 within the slot 31. This positioning of the seat cut marking arm 80 may be accomplished by measurement, or as is the case in the preferred embodiment by simply having a seat cut marking arm 80 of standardized length and slideably adjusting the position of same to a point where the end of the seat cut marking arm 80 meets the edge of the roof rafter 100. The seat cut marking arm 80 is always at an angle of 90° with respect to the length of the bird's mouth marking arm 30 to which it is attached. The bird's mouth or seat cut 102 to be made in the common roof rafter 100 is marked by tracing the long edge of the seat cut marking arm 80 and the edge of the bird's mouth marking arm 30 which faces the common cut marking edge and roof pitch pointer arm 20 between the traced edge of the seat cut marking arm 80 and the edge of the common roof rafter 100 on the surface of the common roof rafter 100.

Finally, the common rafter and hip layout tool 1 is slid down along the side of the common roof rafter 100 being marked until the upper edge of the common cut marking edge and roof pitch pointer arm 20 is at the point previously marked on the common roof rafter 100 for the desired tail length 103. The tail cut 104 is then marked by tracing the upper edge of the common cut marking edge and roof pitch pointer arm 20 on the surface of the common roof rafter 100.

An alternate embodiment (not depicted in the drawings) of the instant invention dispenses with the synchronizing bar 50 and the bird's mouth marking arm 30, places a slot in the length of the common cut marking edge and roof pitch pointer arm 20 and slideably connects the seat cut marking arm 80 to the common cut marking edge and roof pitch pointer arm 20 in such slot. Such alternate embodiment requires that the seat cut marking arm 80 be pivotally connected to the bird's mouth marking arm 30 so that the seat cut marking arm 80 can be positioned along the length of the common cut marking edge and roof pitch pointer arm 20, thus out of the way, when the common ridge cut 101 or the tail cut 104 is being marked on a common roof rafter 100, and positioned at a 90° angle relative to the common cut marking edge and roof pitch pointer arm 20 when the bird's mouth or seat cut 102 is being marked on a common roof rafter 100. In operation of the alternate embodiment, the desired tail length 103 would be measured along the main body 10 between the tail length marking arm 40 and the lower edge of the common cut marking edge and roof pitch pointer arm 20.

While the preferred embodiments of the instant invention have been described in substantial detail and fully and completely hereinabove, it will be apparent to one skilled in the art that numerous variations of the instant invention may be made without departing from the spirit and scope of the instant invention, and accordingly the instant invention is to be limited only by the following claims.

I claim:

1. A common rafter and hip layout tool comprising:

a main body, a common cut marking edge, a bird's mouth marking arm, a tail length marking arm, a synchronizing bar, and a seat cut marking arm;

wherein said main body provides a first slot, said main body provides a head region, said head region provides a protractor portion, said protractor portion provides a second slot, said common cut marking edge provides a roof pitch pointer, said tail length marking arm provides a tail length pointer, said common cut marking edge is pivotally connected to said main body, said common cut marking edge is pivotally connected to said synchronizing bar, said common cut marking edge is slideably connected through said second slot to said protractor portion, said bird's mouth marking arm is pivotally connected to said main body, said bird's mouth marking arm is pivotally connected to said synchronizing bar, said tail length marking arm is slideably connected through said first slot to said main body, said bird's mouth marking arm provides a third slot, said seat cut marking arm is slidably connected through said third slot to said bird's mouth marking arm, and said common cut marking edge, said bird's mouth marking arm, and said synchronizing bar together form a pantograph arm;

whereby when said roof pitch pointer points to the desired angle of roof pitch on said protractor and said tail length pointer points to the desired place for the tail cut and said seat cut marking arm is slideably adjusted in said third slot for the depth of seat cut desired, said bird's mouth marking arm and said seat cut marking arm form a right angle which may be traced for subsequent cutting on a length of material to be used as a common roof rafter to form a seat cut on said length of material; and when said roof pitch pointer points to the desired angle of roof pitch on said protractor, said common cut marking edge may be traced for subsequent cutting on a length of material to be used as a common roof rafter to form a common ridge cut, and said common cut marking edge may be traced for subsequent cutting on a length of material to be used as a common roof rafter to form a tail cut.

2. A common rafter and hip layout tool comprising:

a main body, a common cut marking edge, a tail length marking arm, and a seat cut marking arm;

wherein said rain body provides a first slot, said main body provides a head region, said head region provides a protractor portion, said protractor portion provides a second slot, said common cut marking edge provides a third slot, said common cut marking edge provides a roof pitch pointer, said tail length marking arm provides a tail length pointer, said common cut marking edge is pivotally connected to said main body, said common cut marking edge is slideably connected through said second slot to said protractor portion, said tail length marking arm is slideably connected through said first slot to said main body, and said seat cut marking arm is connected through said third slot to said common cut marking edge;

whereby when said roof pitch pointer points to the desired angle of roof pitch on said protractor and said tail length pointer points to the desired place for the tail cut and said seat cut marking arm is slideably adjusted in said third slot for the depth of seat cut desired, said common cut marking edge and said seat cut marking arm form a right angle which may be traced for subsequent cutting on a length of material to be used as a common roof rafter to form a seat cut on said length of material; and when said roof pitch pointer points to the desired angle of roof pitch on said protractor, said common cut marking edge may be traced for subsequent cutting on a length of material to be used as a common roof rafter to form a common ridge cut, and said common cut marking edge may be traced for subsequent cutting on a length of material to be used as a common roof rafter to form a tail cut.

3. The layout tool of claim 1 wherein the length of said main body is greater than the width of said main body, said first slot is longitudinal with respect to said main body, said protractor portion is at one end of said main body, said protractor portion provides a protractor radial to said pivot connection between said main body and said common cut marking edge said second slot is parallel to said protractor portion, and said third slot is longitudinal with respect to said bird's mouth marking arm.

4. The layout tool of claim 2 wherein the length of said main body is greater than the width of said main body, said first slot is longitudinal with respect to said main body, said protractor portion is at one end of said main body, said protractor portion provides a protractor radial to said pivot connection between said main body and said common cut marking edge said second slot is parallel to said protractor portion, and said third slot is longitudinal with respect to said bird's mouth marking arm.

* * * * *